US006593048B2

(12) United States Patent
Sasaki et al.

(10) Patent No.: US 6,593,048 B2
(45) Date of Patent: Jul. 15, 2003

(54) TWO-COMPONENT DEVELOPER, AND IMAGE FORMING APPARATUS AND IMAGE FORMING METHOD USING THE DEVELOPER

(75) Inventors: Fumihiro Sasaki, Fuji (JP); Yasuaki Iwamoto, Numazu (JP); Hiroaki Matsuda, Numazu (JP); Hiroshi Nakai, Yokohama (JP); Hiroto Higuchi, Numazu (JP); Hyou Shu, Mishima (JP); Maiko Kondo, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/982,877

(22) Filed: Oct. 22, 2001

(65) Prior Publication Data

US 2002/0090562 A1 Jul. 11, 2002

(30) Foreign Application Priority Data

Oct. 20, 2000 (JP) ..... 2000-321397
Sep. 10, 2001 (JP) ..... 2001-273280

(51) Int. Cl.[7] ..... G03G 9/083
(52) U.S. Cl. ..... 430/106.1; 430/111.91; 399/265
(58) Field of Search ..... 430/106.1, 111.35, 430/111.41; 399/265

(56) References Cited

U.S. PATENT DOCUMENTS

| | | | | |
|---|---|---|---|---|
| 2,874,063 | A | | 2/1959 | Greig |
| 4,758,489 | A | | 7/1988 | Tomita et al. |
| 4,762,763 | A | | 8/1988 | Nomura et al. |
| 4,908,290 | A | | 3/1990 | Watanabe et al. |
| 4,933,250 | A | | 6/1990 | Nakayama et al. |
| 4,950,573 | A | | 8/1990 | Yamaguchi et al. |
| 4,980,258 | A | | 12/1990 | Aoki et al. |
| 5,021,315 | A | * | 6/1991 | Goldman ..... 430/106.6 |
| 5,168,028 | A | | 12/1992 | Nanya et al. |
| 5,225,303 | A | | 7/1993 | Tomita et al. |
| 5,288,577 | A | | 2/1994 | Yamaguchi et al. |
| 5,344,732 | A | | 9/1994 | Chiba et al. |
| 5,368,972 | A | | 11/1994 | Yamashita et al. |
| 5,380,616 | A | | 1/1995 | Aoki et al. |
| 5,403,690 | A | | 4/1995 | Kuramoto et al. |
| 5,429,901 | A | | 7/1995 | Muto et al. |
| 5,554,478 | A | | 9/1996 | Kuramoto et al. |
| 5,721,083 | A | | 2/1998 | Masuda et al. |
| 5,771,426 | A | * | 6/1998 | Oka et al. ..... 399/119 |
| 5,840,456 | A | | 11/1998 | Tomita et al. |
| 5,882,832 | A | | 3/1999 | Tosaka et al. |
| 6,004,715 | A | | 12/1999 | Suzuki et al. |
| 6,010,814 | A | | 1/2000 | Kotsugai et al. |
| 6,074,794 | A | | 6/2000 | Fushimi et al. |
| 6,074,795 | A | | 6/2000 | Watanabe et al. |
| 6,103,441 | A | | 8/2000 | Tomita et al. |
| 6,180,298 | B1 | | 1/2001 | Kuroda et al. |
| 6,183,926 | B1 | | 2/2001 | Kuroda et al. |
| 6,215,967 | B1 | * | 4/2001 | Takeda et al. ..... 399/43 |
| 6,228,550 | B1 | | 5/2001 | Matsuda et al. |
| 6,258,502 | B1 | | 7/2001 | Nakamura et al. |
| 6,303,257 | B1 | | 10/2001 | Hasegawa et al. |
| 6,303,258 | B1 | | 10/2001 | Katoh et al. |
| 6,335,137 | B1 | | 1/2002 | Suzuki et al. |
| 6,337,957 | B1 | | 1/2002 | Tamaki et al. |
| 6,360,068 | B1 | | 3/2002 | Kinoshita et al. |
| 6,363,229 | B1 | | 3/2002 | Shiraishi et al. |
| 6,395,443 | B2 | | 5/2002 | Kuroda et al. |
| 6,403,275 | B1 | | 6/2002 | Kuramoto et al. |
| 6,406,826 | B1 | | 6/2002 | Suzuki et al. |
| 6,432,589 | B1 | | 8/2002 | Uchinokura et al. |
| 6,442,364 | B2 | | 8/2002 | Kai et al. |
| 6,468,706 | B2 | | 10/2002 | Matsuda et al. |
| 6,505,014 | B2 | | 1/2003 | Aoki et al. |
| 6,507,718 | B2 | | 1/2003 | Ohjimi et al. |

FOREIGN PATENT DOCUMENTS

| | | |
|---|---|---|
| JP | 5-67233 | 1/1988 |
| JP | 63-4282 | 1/1988 |

* cited by examiner

*Primary Examiner*—John Goodrow
(74) *Attorney, Agent, or Firm*—Oblon, Spivak, McClelland, Maier & Neustadt, P.C.

(57) ABSTRACT

A two-component developer includes at least a magnetic toner and a magnetic carrier. The magnetic toner has magnetic particles coated with a carbon black layer. The magnetic toner adheres to the magnetic carrier due to the magnetic interaction.

20 Claims, 2 Drawing Sheets

TWO-COMPONENT DEVELOPER, AND IMAGE FORMING APPARATUS AND IMAGE FORMING METHOD USING THE DEVELOPER

CROSS-REFERENCE TO RELATED APPLICATION

This document claims priority and contains subject matter related to Japanese Patent Application Nos. 2000-321397 filed on Oct. 20, 2000 and 2001-273280 filed on Sep. 10, 2001, the entire contents of which are incorporated herein by reference.

BACKGROUND OF THE INVENTION

1. Field of the Invention

The present invention relates to a developer as well as an image forming apparatus and method using the developer.

2. Discussion of the Background

As conventional latent image developing methods using a toner, two-component developing methods represented by a magnetic brush developing method disclosed in U.S. Pat. No. 2,874,063 and one-component developing methods are known.

In a dry type two-component developer used for a two-component developing method, fine toner particles are retained on the surface of relatively larger carrier particles by static electricity caused by friction between both particles. When the toner particles come close to a latent image, the toner particles are attracted to the latent image and the latent image is visualized, because the electric field strength of the latent image attracting the toner particles is larger than the binding strength between the toner particles and the carrier particles. Thus, the developer is repeatedly used, refilling the toner consumed for the development.

Therefore, the mixing ratio of the carrier and the toner, (i.e., the toner concentration) should be fixed to form a stable image density in the two-component developing method. Accordingly, a toner supplying mechanism and a toner concentration sensor are required for the developing device, which increases the size of the device and makes the printing operation more complicated.

On the other hand, in a one-component developing method, static electricity caused by friction between a toner and a developing sleeve of the developing device or a magnetic attraction between the toner's magnetic particles and the developing sleeve's magnet retains the toner on the developing sleeve. When the toner particles come close to a latent image, the toner particles are attracted to the latent image because the electric field strength of the latent image attracting the toner particles is larger than the binding strength between the toner particles and the developing sleeve.

Therefore, the one-component developing method is advantageous because the toner concentration does not need to be controlled. Thus, the size of the developing device can be reduced. However, it is difficult to apply the one-component developing method to a high-speed copier because the concentration of the toner particles in the developing area is smaller than that of the two-component developer and the developed volume of the toner on a photoreceptor is not enough.

Further, even in the two-component developing method, when the toner is not charged enough because the linear velocity of the developing sleeve is fast in a high-speed copier, the toner on the developer tends to leave the carrier, resulting in toner scattering. Therefore, the magnetic two-component developer including the magnetic toner is used even in the two-component developing method.

However, when the magnetic toner is used for the two-component developer, the toner magnetization becomes large if the volume of the magnetic particles is increased, resulting in deterioration of the developing capability in the two-component developing method. Further, when the volume of the magnetic particles is decreased, a reddish image without enough density is produced. To improve the drawback, when a non-magnetic black pigment such as carbon black is used, the chargeability of the toner deteriorates and background fouling tends to occur.

SUMMARY OF THE INVENTION

Accordingly, an object of the present invention is to provide a two-component developer which sufficiently charges a toner and forms a quality image without toner scattering and background fouling.

To achieve these and other objects, the present invention provides a two-component developer including a magnetic toner including magnetic particles coated with carbon black, and a magnetic carrier configured to carry the magnetic toner on a surface thereof.

BRIEF DESCRIPTION OF THE DRAWINGS

Various other objects, features and attendant advantages of the present invention will be more fully appreciated as the same becomes better understood from the detailed description when considered together with the accompanying drawings in which like reference characters designate like corresponding parts throughout and wherein.

DESCRIPTION OF THE PREFERRED EMBODIMENTS

Figure 1:
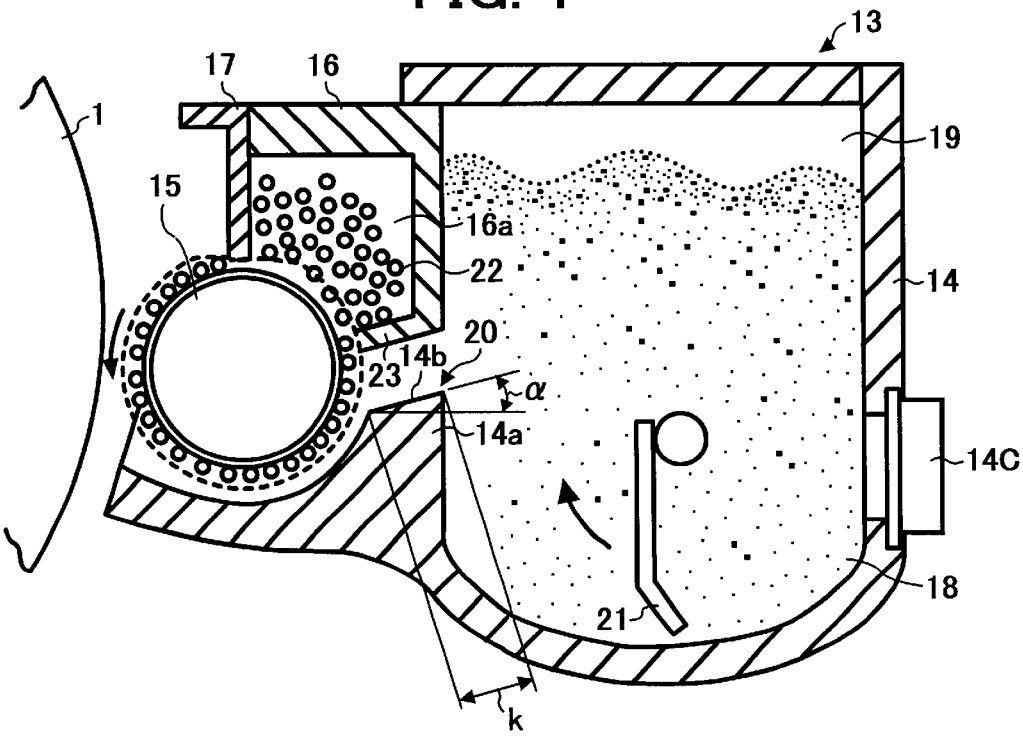
FIG. 1 is a schematic view illustrating the cross section of an embodiment of the developing device of the image forming apparatus of the present invention.

Referring now to the drawings, wherein like reference numerals designate identical or corresponding parts throughout the several views, the present invention will be described.

Generally, the present invention provides a two-component developer including at least a magnetic toner (A) and a magnetic carrier (B) having complex magnetic particles coated with carbon black.

A toner used in the present invention can be a toner made by known methods. Specifically, the toner is formed by the following method:

(1) a mixture including a binder resin, magnetic particles, a polarity controller and an optional additive are kneaded upon application of heat;

(2) the mixture is cooled, pulverized and classified; and then (3) an external additive is optionally mixed with the mixture.

A binder resin used in the present invention can be known resins. Specific examples of the resin include styrene and its substitute polymers such as polystyrene, poly-p-chlorostyrene and polyvinyltoluene; styrene copolymers such as styrene-p-chlorostyrene copolymers, styrene-vinyltoluene copolymers, styrene-vinylnaphthalene copolymers, styrene-acrylic ester copolymers, styrene-methacrylic ester copolymers, styrene-methylα chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-isoprene copolymers and styrene-acrylonitrile-indene copolymers; poly vinyl chloride, phenolic resins, natural resin-modified phenolic resins, natural resin-modified maleic acid resins, acrylic resins, methacrylic resins, poly vinyl acetate, silicone resins, polyester resins, polyurethane, polyamide resins, furan resins, epoxy resins, xylene resins, poly vinyl butyral, rosin, modified rosin, terpene resins, coumarone-indene resins, aliphatic or aliphatic hydrocarbon resins, aromatic petroleum resins, chlorinated paraffin and paraffin waxes. These can be used alone or in combination.

Particularly in a heat/pressure fixing method, a polyester resin used as a binder resin can form a toner which is good at polyvinyl-chloride adhesion resistance and offset resistance against a heat roll.

Specific examples of binder resins for use in a pressure fixing method include polyethylene, polypropylene, polymethylene, polyurethane elastomers, ethylene-ethylacrylate copolymers, ethylene-vinyl acetate copolymers, ionomer resins, styrene-butadiene copolymers, styrene-isoprene copolymers, saturated linear polyester and paraffin.

A polarity controller is preferably used for toner particles added internally or externally. The polarity controller controls the charging volume of the toner, and is particularly effective in the above-mentioned developing method which does not need the toner concentration control.

Known materials can be used as a polarity controller. Specific examples of the positive polarity controllers include compounds modified by such as nigrosin and fatty acid metal salts; quaternary ammonium salts such as tributylbenzylammonium-1-hydroxy-4-naphtholsulfonic acid salts and tetrabutylammonium-tetrafluoroborate; diorgano tin oxide such as dibutyl tin oxide, dioctyl tin oxide and dicyclohexyl tin oxide; diorgano tin borate such as dibutyl tin borate, dioctyl tin borate and dicyclohexyl tin borate. These can be used alone or in combination. Particularly, polarity controllers such as nigrosin compounds and organic quaternary ammonium are preferably used.

Further, organic metallic compounds and chelate compounds are used as negative polarity controllers. Specific examples of the negative polarity controllers include aluminiumacetylacetonate, iron(II)acetylacetonate, and 3-5-ditertiary-butylchrome salycilate. Particularly, acetyl acetone metal complex, mono azo metal complex and naphthoic or salicylic acid metal complex or salts are preferably used. Salicylic metal complex and mono azo metal complex or salicylic metal salts are more preferably used.

The polarity controller is preferably used in a form of fine particles having an average particle diameter of not greater than 3 μm.

The volume of the polarity controller for use in a toner is determined by a type of the binder resin, an additive optionally used, and a method for manufacturing the toner including a toner dispersing method. From 0.1 to 20 parts by weight, and preferably from 0.2 to 10 parts by weight of the polarity controller per 100 parts by weight of the binder resin are used. Also, the toner is not charged enough when the volume of the polarity controller is less than 0.1 parts by weight. In addition, when the polarity controller is greater than 20 parts by weight, the toner is charged so much that the static electricity thereof attracting the carrier increases, resulting in deterioration of the fluidity of the developer and deterioration of the resultant image density.

Magnetic particles used in the magnetic toner (A) of the present invention include a magnetic iron oxide such as magnetite, hematite and ferrite coated with carbon black using a silane coupling agent as a binder resin to produce an image having enough density even with a small amount of the toner because the color of the magnetic particles is black. In addition, the toner particles can be charged enough to prevent toner scattering and background fouling.

The content of the silane coupling agent is from 0.3 to 3.0% by weight, and preferably from 0.3 to 1.5% by weight per 100% by weight of the magnetic particles. When the silane coupling agent is less than 0.3% by weight, the carbon black does not firmly adhere to the magnetic particles and unadheres in the dispersion process of the magnetic particles when manufacturing the toner, resulting in background fouling.

When the silane coupling agent is greater than 3% by weight, the magnetic particles are not uniformly coated with the carbon black, resulting in deterioration of the dispersibility of the magnetic particles in the toner and formation of the agglomerated particles.

The toner (A) according to the present invention includes from 3 to 20% by weight, and preferably from 5 to 15% by weight of the carbon black per 100% by weight of the magnetic particles. When the carbon black is less than 3% by weight, the resultant image density is low because the magnetic particles are not black enough. When the carbon black is greater than 20% by weight, the fluidity of the magnetic particles decreases and the dispersibility thereof decreases when manufacturing the toner. In addition, the carbon black easily leaves the magnetic particles, resulting in an abnormal image such as background fouling.

Further, the magnetic particle powder can be coated with the silane coupling agent in such a way that the magnetic particle powder is mixed and stirred while being sprayed with a liquid of the silane coupling agent.

Specific examples of the silane coupling agent used for the binder resin include hexamethyldisilazane, trimethylsilane, trimethylchlorsilane, trimethylethoxysilane, dimethyldichlorsilane, methyltrichlorsilane, allyldimethylchlorsilane, allylphenyldichlorsilane, benzylmethylchlorsilane, bromomethyldimethylchlorsilane, α-chlorethyltrichlorsilane, β-chlorethyltrichlorsilane, chlormethyldimethylchlorsilane, triorganosilanemethylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane and 1,3-diphenyltetramethyldi-siloxane.

The magnetite used for the magnetic particles is made by known manufacturing methods. For example, the methods include (1) an aqueous liquid of iron sulfate being neutralized by an alkaline liquid to form an iron hydroxide; (2) the iron hydroxide slurry having not less than 10 pH being oxidized by a gas including an oxide to form a magnetite slurry; and then (3) the slurry being washed by water, filtered, dried and pulverized to form magnetite particles.

The magnetic particles are preferably spherical particles which do not include silicon or aluminum, having an average particle diameter of from 0.2 to 0.4 μm, preferably from 0.2 to 0.3 μm to decrease the change of the chargeability of the toner due to humidity. The content of the magnetic particles in the magnetic toner is preferably from 5 to 80% by weight, and more preferably 10 to 30% by weight per 100% by weight of the toner.

The magnetic toner (A) used in the present invention has a magnetization of from 10 to 30 emu/g, and preferably from 15 to 25 emu/g at a magnetic field of 1000 Oe, because the developer can take in the toner effectively and the deterioration of the image density can be prevented even when an image consuming a lot of toner is copied repeatedly. A magnetization of the magnetic particles of the magnetic toner (A) is from 30 to 90 emu/g, preferably from 30 to 70 emu/g at a magnetic field of 1000 Oe, so to satisfy the magnetic properties of the magnetic toner (A). In addition, the toner scattering and the toner development on the background due to the rotation of the developer carrier can be effectively prevented because of the magnetic binding energy of the magnetized toner in the direction of the developer carrier. Further, the adhesion of the developer leaving from the developing sleeve on the photoreceptor can be prevented, and the developer can include enough toner when the particle diameter of the carrier included in the developer. Therefore, an image having sufficient density and a quality reproduction of a thin line can be produced.

When the magnetization is less than 10 emu/g, the magnetic bias effect is small, resulting in toner scattering and background fouling. When the magnetization is greater than 30 emu/g, the magnetic bias effect is large, resulting in a decrease of the resultant image density.

The content of the magnetic particles used in the magnetic toner (A) of the present invention is from 10 to 30% by weight, and preferably from 15 to 25% by weight per 100% by weight of the toner. In addition, the specific surface area is from 1 to 60 $m^2/g$, and preferably from 3 to 20 $m^2/g$. Further, the resistance and chargeability of the toner are compatible by the content and the specific surface area of the magnetic particles, resulting in formation of an image having high image density without background fouling.

Also, a colorant such as pigments and dyes can be optionally added into the toner (A) of the present invention. The pigment includes carbon black, aniline black, furnace black, lamp black, etc. for the black colorant. The cyan colorant includes Phthalocyanine Blue, Methylene Blue, Victoria Blue, Methyl Violet, Aniline Blue, Ultra Marine Blue, etc. The magenta colorant includes Rhodamine 6G Lake, dimethyl quinacridone, Watching Red, Rose Bengal, Rhodamine B, Alizarine Lake, etc., and the yellow colorant includes chrome yellow, Benzidine Yellow, Hansa Yellow, Naphthol Yellow, Molybdenum Orange, Quinoline Yellow, Tartrazine, etc. In addition, the content of the pigment is from 0.1 to 20 parts by weight, and preferably from 2 to 10 parts by weight per 100 parts by weight of the binder resin in the toner.

Specific examples of the dyes include azo dyes, anthraquinone dyes, xanthein dyes, methine dyes, etc. The content of the dye is from 0.05 to 10 parts by weight and preferably from 0.1 to 3 parts by weight per 100 parts by weight of the binder resin in the toner.

An additive is preferably used for the toner of the present invention to improve the chargeability, the developing capability, the fluidity and the durability. Specific examples of the additives of fluidity improvers include metal oxide such as cerium oxide, zirconium oxide, silicon oxide, titanium oxide, aluminum oxide, zinc oxide and antimony oxide; and fine particles of silicon carbide and silicon nitride. Specific examples of the additives of cleaning auxiliaries include fine particles of resins such as fluorocarbon resins, silicone resins and acrylic resins; and metallic soap lubricants such as zinc stearate, calcium stearate, aluminum stearate and magnesium stearate.

Among the additives, silicon oxide and titanium oxide are preferably used for the fluidity improver. Zinc stearate is preferably used for the cleaning auxiliary.

Also, it is preferable the fluidity improver used in the present invention is optionally treated by silicone varnish, various modified silicone varnish, silicone oil, various modified silicone oil, silane coupling agent, other organic silicon compounds or combinations of various treating agents.

A release agent can also be included in the toner of the present invention to improve the releasability in fixing. For example, known release agents such as low molecular weight polyethylene, low molecular weight polypropylene, microcrystalline waxes, carnauba waxes, sasol waxes, paraffin waxes can be used.

In addition, from 0.1 to 10% by weight of the release agent is preferably included in the magnetic toner per 100% by weight of the binder resin.

The carrier included in the developer of the present invention has magnetization of from 30 to 120 emu/g, and preferably from 40 to 100 emu/g at a magnetic field of 1000 Oe so as to increase the magnetic binding energy of the developer toward the developing sleeve in the developing area. Consequently, the adhesion of the carrier on the photoreceptor is effectively prevented to form a quality image.

Further, the carrier included in the developer of the present invention has an average particle diameter of from 20 to 100 μm, and preferably from 20 to 80 μm so as to increase the toner concentration in the layer of the developer in the developing area, resulting in formation of a quality image with high image density even in a high-speed image forming apparatus.

Known core particles can be used for those of the carrier included in the developer of the present invention. Specific examples of the core particles include ferromagnetic metals such as iron, cobalt and nickel; metal alloys and compounds such as magnetite, hematite and ferrite; and complexes of the above-mentioned ferromagnetic particles and resins, etc.

The carrier used in the present invention is preferably coated by a resin to improve the durability. Specific examples of the resins coating the carrier include polyolefin resins such as polyethylene, polypropylene, chlorinated polyethylene and chlorosulfonated polyethylene; polyvinyl and polyvinylidene resins such as polystyrene, acryl (e.g. polymethylmethacrylate), polyacrylonitrile, polyvinyl acetate, polyvinyl alcohol, polyvinylbutyral, polyvinyl chloride, polyvinylcarbazole, polyvinyl ether and polyvinyl ketone; vinylchloride-vinylacetate copolymers; silicone resins including an organosiloxane bond or the modified resins (e.g. resins modified by alkyd resins, polyester resins, epoxy resins, polyurethane, etc.); fluorocarbon resins such as polytetrafluoroethylene, polyvinyl fluoride, polyvinylidene fluoride and polychlorotrifluoroethylene; polyamide; polyester; polyurethane; polycarbonate; amino resins such as urea-formaldehyde resins; and epoxy resins, etc. Among the resins, silicone resins or the modified resins and fluorocarbon resins are preferably used, and the silicone resins or the modified resins are more preferably used in order to prevent a spent-toner, where a film of the toner is formed on the surface of the carrier due to a heat caused by mutual collision of the developer particles, etc.

The silicone resin used in the present invention include any known silicone resins. The straight silicone formed from only the organosiloxane bond shown by the following formula (1) and silicone resins modified by alkyd, polyester, epoxy, urethane, etc. can be used.

(1)

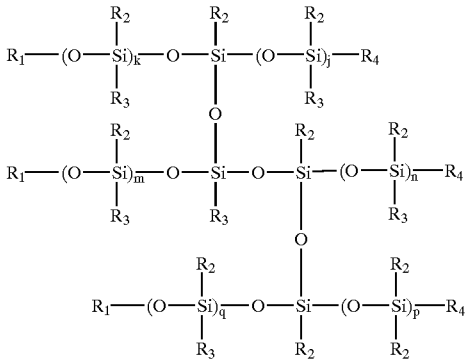

where $R_1$ represents a hydrogen atom and an alkyl group or a phenyl group having 1 to 4 carbon atoms; $R_2$ and $R_3$ represent a hydrogen group, an alkoxy group having 1 to 4 carbon atoms, a phenyl group, a phenoxy group, an alkenyl group having 2 to 4 carbon atoms, an alkenyloxy group having 2 to 4 carbon atoms, a hydroxy group, a carboxyl group, an ethylene oxide group, a glycidyl group or a group shown by the following formula (2):

(2)

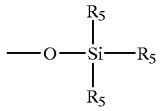

where $R_4$ and $R_5$ represent a hydroxy group, a carboxyl group, an alkyl group having 1 to 4 carbon atoms, an alkenyl group having 2 to 4 carbon atoms, an alkenyloxy group having 2 to 4 carbon atoms, a phenyl group and a phenoxy group; and j, k, m, n, p and q are integers.

The above-mentioned substituents may have a substituent such as an amino group, a hydroxy group, a carboxyl group, a mercapto group, a phenyl group, an ethylene oxide group, a glycidyl group and halogen atoms.

Further, an electroconductive additive can be dispersed in the coated layer of the carrier used in the present invention to control the volume resistivity. Known electroconductive additives can be used. For example, metals such as iron, gold and copper; iron oxide such as ferrite and magnetite; and pigments such as carbon black can be used. Among the additives, even a small amount of a mixture of furnace black and acetylene black which are both one of carbon black can effectively control the conductivity. In addition, a carrier with a coated layer having high abrasion resistance can be formed. The electroconductive fine particles preferably have a particle diameter of from 0.01 to 10 $\mu$m. In addition, preferably 2 to 30 parts by weight, and more preferably 5 to 20 parts by weight of the electroconductive fine particles are added to the coated layer of the carrier.

To improve the adhesion of the coated layer to the core particles of the carrier and to improve the dispersibility of the electroconductive additive, a silane coupling agent, a titanium coupling agent, etc. can be added into the coated layer of the carrier.

The silane coupling agent used in the present invention is a compound shown by the following formula (3):

$$YRSiX_3 \quad (3)$$

where X represents a hydrolysis group bonded with a silicon atom such as a chlor group, an alkoxy group, an acetoxy group, an alkyl amino group and a propenoxy group; Y represents an organic functional group reacted with an organic matrix such as a vinyl group, a methacryl group, an eposxy group, a glycidoxy group, an amino group and a mercapto group; and R represents an alkyl group or an alkylene group having 1 to 20 carbon atoms.

Further, an amino silane coupling agent having an amino group in Y is preferably used to form a developer having a negative charge, and an epoxy silane coupling agent having an epoxy group in Y is preferably used to form a developer having a positive charge.

Conventional methods such as spray methods and dip methods can be used to form a coated layer on the core particles of the carrier. The thickness of the coated layer is preferably from 0.1 to 20 $\mu$m.

In addition, the weight ratio of the magnetic toner (A) and the magnetic carrier (B) for use in the present invention is from 10/90 to 50/50 to keep enough volume of the toner for development in the developing area, and an image having enough density and good reproduction of a thin line can be produced.

Turning now to FIG. 1, which is a schematic view illustrating the cross section of an embodiment of the developing device of the image forming apparatus of the present invention.

As shown, a developing device 13 is arranged on the side of a photoreceptor drum 1 which is a latent image carrier. The developing device 13 includes a support case 14, a developing sleeve 15 (i.e., a developer carrier), a developer containing member 16 and a first doctor blade 17 (i.e., a developer regulating member).

The support case 14 has an opening on the side of the photoreceptor drum 1 and forms a toner hopper 19 containing a toner 18. As shown, the developer containing member 16 is formed next to the support case 14, and includes a developer container 16*a* containing a developer 22 formed from the toner 18 and a carrier made of magnetic particles.

In addition, the support case 14 arranged below the developer containing member 16 forms a projection 14*a* having an opposing surface 14*b* facing the developer containing member 16. A toner supply opening 20 is formed between the bottom part of the developer containing member 16 and the opposing surface 14*b* so as to supply the toner 18.

A toner agitator 21 is included the toner hopper 19 and is rotated by a drive unit (not shown). The toner agitator 21 transfers the toner 18 in the toner hopper 19 toward the toner supply opening 20 while agitating the toner. Further, the developing device 13 includes a toner end detector 14*c* for detecting the toner volume in the toner hopper 19.

The developing sleeve 15 is arranged between the photoreceptor drum 1 and the toner hopper 19, and rotates in a direction indicated by an arrow by a drive unit (not shown). The sleeve 15 also includes an internal magnet generating a magnetic field (not shown). Further, as shown, the containing member 16 connects with the first doctor blade 17, which is arranged such that a fixed clearance is maintained between the tip of the blade 17 and the surface of the developing sleeve 15.

In addition, the developing device 13 includes a second doctor blade 23 at a part of the developer containing member 16 which is close to the toner supply opening 20. The second doctor blade 23 functions as a regulating member and is arranged such that the free tip thereof projects in a direction towards the developing sleeve 15, thus preventing the flow of the developer 22 along the surface of the developing sleeve 15 towards the opening 20, while maintaining a fixed clearance therefrom.

Also, the developer container 16*a* is formed so as to have an enough space in which the developer 22 is circulated within a range of the magnetic attraction of the developing sleeve 15. Further, the opposing surface 14*b* is formed so that the surface descends to the developing sleeve 15 from the toner hopper 19, and has a predetermined length k. Therefore, even when the carrier in the developer container 16*a* falls through the gap between the second doctor blade 23 and the developing sleeve 15 due to a vibration, a magnetic force irregularity of the magnet in the developing sleeve 15 and a partial increase of the toner concentration in the developer 22, the carrier is received by the opposing surface 14*b* and moved to the developing sleeve 15.

Further, the carrier is magnetically attracted by the developing sleeve 15 and supplied again to the developer container 16*a*. Thus, a decrease of the carrier in the developer container 16*a* can be prevented, and therefore an image density irregularity in the direction of the axis of the developing sleeve 15 can be prevented. An inclination angle a of the opposing surface 14*b* is preferably about 5°, and the predetermined length k is preferably from 2 to 20 mm, and more preferably from 3 to 10 mm.

Additionally, the toner 18 transferred by the toner agitator 21 from the toner hopper 19 is supplied through the toner supply opening 20 to the developer 22 in the developer container 16*a* by the developing sleeve 15. Then, the developer 22 in the developer container 16*a* is carried by the developing sleeve 15 to a position facing the surface of the photoreceptor drum 1, where only the toner 18 is electrostatically combined with the electrostatic latent image formed on the photoreceptor drum 1 to form a toner image thereon.

Figure 2:
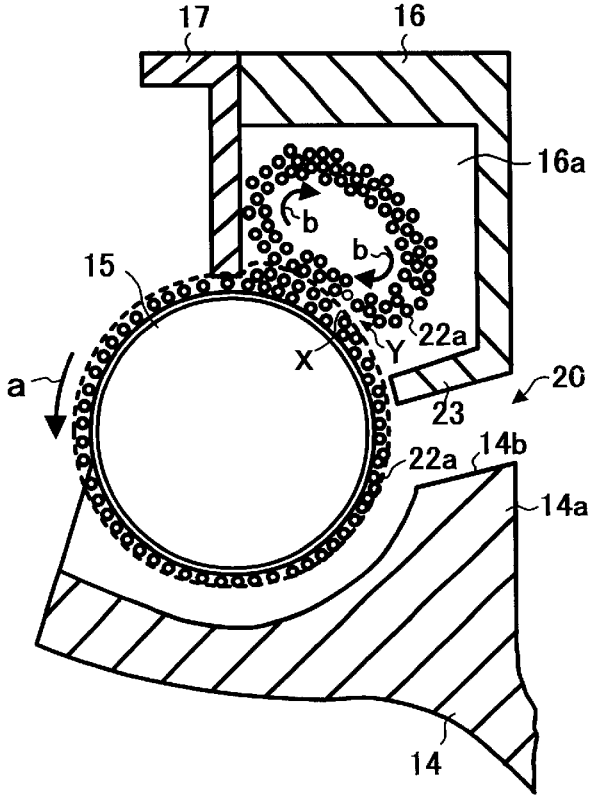
FIG. 2 is a partial cross section for explaining the movement of the developer in the embodiment of the image forming apparatus of the present invention.

As shown in FIG. 2, when a starter including only a magnetic carrier 22*a* is in the developing device 13, the magnetic carrier 22*a* is separated into the carrier magnetically attracted to the surface of the developing sleeve 15 and the carrier contained in the developer container 16*a*. Further, the magnetic carrier 22*a* contained in the developer container 16*a* is circulated at a speed of not less than 1 mm/sec. in the direction indicated by an arrow b by the magnetic attraction of the developing sleeve 15 in accordance with the rotation thereof in the direction indicated by an arrow a.

Then, an interface X is formed between the surface of the magnetic carrier 22*a* attracted on the developing sleeve 15 and the surface of the magnetic carrier 22*a* circulating in the developer container 16*a*.

Next, the toner 18 in the toner hopper 19 is supplied through the toner supply opening 20 to the magnetic carrier 22*a* carried by the developing sleeve 15. Therefore, the developing sleeve 15 carries the developer 22 which is a mixture of the toner 18 and the magnetic carrier 22*a*.

Further, in the developer container 16*a*, there is a force to prevent the transport of the developer 22 transported by the developing sleeve 15 by the developer 22 contained in the developer container 16*a*. When the toner 18 on the surface of the developer 22 carried by the developing sleeve 15 is transported to the interface X, the frictional force of the developer 22, which is close to the interface X, lowers and the transportability thereof lowers, resulting in a decrease of the transport volume thereof.

Figure 3:
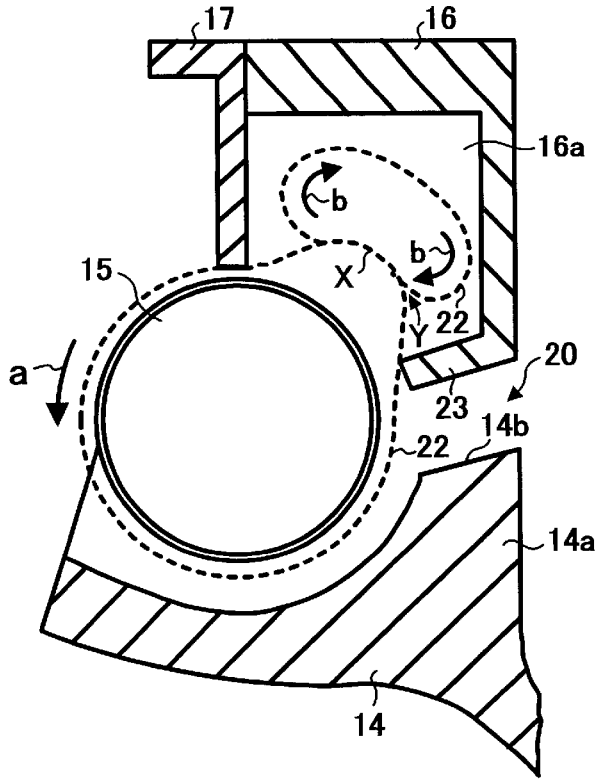
FIG. 3 is another partial cross section for explaining the movement of the developer in the embodiment.

On the other hand, there is not such a force as to prevent the transport of the developer 22 transported by the developing sleeve 15 from a confluence Y to the upstream of the rotating direction of the developing sleeve 15. Therefore, as shown in FIG. 3, the balance of the transport volume between the developer 22 transported to the confluence Y and the developer 22 transported through the interface X is lost, and the developer 22 piles up, resulting in a rise of the confluence Y and an increase of the layer thickness of the developer including the interface X.

Figure 4:
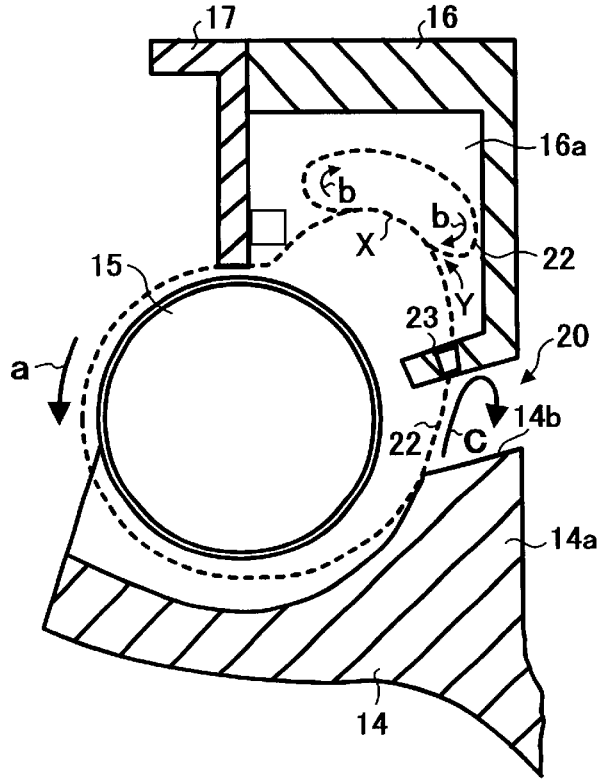
FIG. 4 is yet another partial cross section for explaining the movement of the developer in the embodiment.

In addition, the layer thickness of the developer 22 passed through the first doctor blade 17 gradually increases, which is scraped off by the second doctor blade 23. When the developer 22 passed through the first doctor blade 17 has the predetermined toner concentration, the developer 22 scraped off by the second doctor blade 23 forms a layer to occupy the toner supply opening 20 so as to stop receiving the toner 18 as shown in FIG. 4.

At this point, the developer 22 increases in the developer container 16*a* because the toner concentration becomes higher, and the space in the developer container 16*a* becomes smaller, resulting in lowering of the circulating speed of the developer 22 in the direction indicated by an arrow b. Further, the developer 22 scraped off by the second doctor blade 23 moves at a speed of not less than 1 mm/sec. in the direction indicated by an arrow c in FIG. 4 and is received by the opposing surface 14*b*. Since the opposing surface 14*b* descends to the developing sleeve 15 at the angle of $\alpha$ and has the predetermined length k, the developer 22 is prevented from falling into the toner hopper 19 due to the movement of the layer of the developer 22. Therefore, a sufficient volume of the developer 22 and the toner can be constantly supplied.

Turning now to some examples performed by the inventors. The examples are provided for illustration purposes only and are not intended to be limiting. Further, in the descriptions in the following examples, the numbers represent weight ratios in parts, unless otherwise specified.

EXAMPLES

Magnetic Material Manufacturing Example 1

Complex magnetic particles 1 were prepared by the following method:

(1) 0.5 parts of the solid content of a methyltrimethoxysilane liquid were added into 100 parts of magnetite, and the mixture was mixed and stirred by a Henschel mixer for 30 minutes;

(2) 12 parts of carbon black were added into the mixture, which was mixed and stirred for 60 minutes; and then (3) the mixture was dried at 105° C. for 60 minutes after the carbon black fine particle powder adhered to the methyltrimethoxy silane coating.

The complex magnetic particles 1 had the following properties:

(1) the average particle diameter was 0.2 $\mu$m;

(2) the content of FeO was 20 wt %;

(3) the specific surface area was 8.3 m/g; and (4) the magnetization was 61 emu/g.

Magnetic Material Manufacturing Examples 2 to 9

The procedure for preparation of the complex magnetic particles 1 was repeated to prepare complex magnetic particles 2 to 8 and magnetic particles 9 except for using the formulations shown in Table 1.

Toner Manufacturing Example 1

The following materials were mixed by a Henschel mixer:

| | |
|---|---|
| Polyester resin | 100 |
| Azo dye including chrome | 3 |
| Carnauba wax | 5 |
| Complex magnetic particles 1 | 70 |

(1) the mixture was kneaded by a kneading extruder at 140° C. and hardened by cooling;
(2) the hardened mixture was crushed by a cutter mill and pulverized by a mechanical pulverizer;
(3) the resultant pulverized powder was classified by a classifier using Coanda effect to obtain a mother toner having an average particle diameter of 8 $\mu$m; and
(4) 0.3 parts of hydrophobic colloidal silica and 0.2 parts of hydrophobic titanium oxide were added into 100 parts of the mother toner and mixed by a Henschel mixer to prepare toner particles "a".

The magnetization of the toner at a magnetic field of 1000 Oe was 24 emu/g.

Toner Manufacturing Examples 2 to 9

The procedure for preparation of the toner particles "a" was repeated to prepare toner particles "b" to "i" except for using the magnetic particles 2 to 9 shown in Table 1.

TABLE 1

| Toner | Name of Toner | Name of Magnetic Particles | Silane coupling Agent (parts by weight) | Carbon (parts by weight) |
|---|---|---|---|---|
| Manufacturing example 1 | a | Magnetic Particles 1 | 0.5 | 12 |
| Manufacturing example 2 | b | Magnetic Particles 2 | 0.3 | 12 |
| Manufacturing example 3 | c | Magnetic Particles 3 | 1.5 | 12 |
| Manufacturing example 4 | d | Magnetic Particles 4 | 3.0 | 12 |

TABLE 1-continued

| Toner | Name of Toner | Name of Magnetic Particles | Silane coupling Agent (parts by weight) | Carbon (parts by weight) |
|---|---|---|---|---|
| Manufacturing example 5 | e | Magnetic Particles 5 | 7.0 | 12 |
| Manufacturing example 6 | f | Magnetic Particles 6 | 0.0 | 12 |
| Manufacturing example 7 | g | Magnetic Particles 7 | 0.5 | 3 |
| Manufacturing example 8 | h | Magnetic Particles 8 | 0.5 | 20 |
| Manufacturing example 9 | I | Magnetic Particles 9 | 0.0 | 0 |

Toner Manufacturing Example 10

The procedure for preparation of the toner particles "a" was repeated to prepare toner particles "j" except for using the following carbon complex magnetic particles:

(1) the average particle diameter was 0.2 $\mu$m;
(2) the content of FeO was 20 wt %;
(3) the specific surface area was 8.0 m/g; and
(4) the magnetization was 61 emu/g.

The magnetization of the toner at a magnetic field of 1000 Oe was 24 emu/g.

Toner Manufacturing Examples 11 to 20

The procedure for preparation of the toner particles "j" was repeated to prepare toner particles "k" to "t" except for using the carbon complex magnetic particles shown in Table 2.

Toner Manufacturing Example 21

The procedure for preparation of the toner particles a was repeated to prepare toner particles u except that the carbon complex magnetic particles were not used.

The properties of the toner particles "j" to "u" are shown in the following Table 2.

TABLE 2

| | | | Volume of added | Magnetic Particles | | | |
|---|---|---|---|---|---|---|---|
| Toner | Name of Toner | Toner Magneti-zation (emu/g) | Magnetic Particles (parts by Weight) | Magneti-zation (emu/g) | Average particle diameter ($\mu$m) | Volume of FeO (wt %) | Surface Area ($m^2$/g) |
| Manufacturing example 10 | j | 24 | 70 | 61 | 0.2 | 20 | 8.0 |
| Manufacturing example 11 | k | 30 | 70 | 76 | 0.23 | 22 | 7.1 |
| Manufacturing example 12 | l | 18 | 70 | 45 | 0.26 | 19 | 9.4 |
| Manufacturing example 13 | m | 11 | 70 | 29 | 0.33 | 15 | 3.9 |
| Manufacturing example 14 | n | 26 | 70 | 67 | 0.4 | 21 | 4.2 |
| Manufacturing example 15 | o | 26 | 70 | 65 | 0.14 | 19 | 13.8 |
| Manufacturing example 16 | p | 19 | 70 | 49 | 0.03 | 22 | 60.0 |
| Manufacturing example 17 | q | 25 | 70 | 64 | 0.21 | 11 | 8.3 |

TABLE 2-continued

| Toner | Name of Toner | Toner Magneti-zation (emu/g) | Volume of added Magnetic Particles (parts by Weight) | Magnetic Particles Magneti-zation (emu/g) | Average particle diameter (μm) | Volume of FeO (wt %) | Surface Area ($m^2/g$) |
|---|---|---|---|---|---|---|---|
| Manufacturing example 18 | r | 9 | 20 | 60 | 0.45 | 26 | 2.3 |
| Manufacturing example 19 | s | 40 | 200 | 61 | 0.22 | 20 | 8.0 |
| Manufacturing Example 20 | t | 24 | 70 | 61 | 0.22 | 26 | 8.0 |
| Manufacturing Example 21 | u | 0 | 0 | — | — | — | — |

Carrier Manufacturing Example 1

100 parts of magnetite made by a wet process, 2 parts of polyvinylalcohol and 60 parts of water were put into a ball mill and mixed for 12 hrs. to prepare a magnetite slurry. The slurry was sprayed by a spray dryer to form spherical particles having an average diameter of 54 μm.

The particles were burnt in a nitrogen environment at 1000° C. for 3 hrs. to prepare core particles 1.

The following materials were mixed by a homomixer for 20 min. to prepare a coating liquid 1.

| | |
|---|---|
| Liquid of silicone resin | 100 |
| Toluene | 100 |
| γ -aminopropyltrimethoxy silane | 6 |
| Carbon black | 10 |

The coating liquid 1 was coated on 1000 parts of the core particles 1 using a fluidized bed coater to prepare a carrier A coated by the silicone resin. The carrier particles had an average particle diameter of 58 μm, and a magnetization of 65 emu/g.

Carrier Manufacturing Example 2

(1) 24 mol % of CuO, 25 mol % of ZnO, 51 mol % of $Fe_2O_3$ and water were mixed and pulverized in a wet type ball mill for 12 hrs. to prepare a slurry; (2) The slurry was preliminarily burnt at 1000° C. after dried and pulverized; (3) the slurry was further pulverized by the wet type ball mill for 10 hrs; (4) a dispersant and a binder were added into the slurry; (5) the slurry was dried by a spray dryer and burnt by an electric furnace at 1100° C. for 3 hrs.; and then (6) the slurry was pulverized and classified to prepare core particles 2 having an average particle diameter of 51 μm.

The core particles were coated in the same method as that of Carrier manufacturing example 1 to prepare a carrier B. The carrier particles had an average particle diameter of 55 μm, and a magnetization of 51 emu/g.

Carrier Manufacturing Example 3

30 parts of polyester resin and 70 parts of magnetite fine particles having an average particle diameter of 0.8 μm were kneaded, pulverized and classified to prepare carrier particles C having an average particle diameter of 53 μm. The carrier particles had a magnetization of 42 emu/g.

Example 1

100 parts of the carrier A and 25 parts of the toner a were mixed by a Turbula mixer to prepare a developer.

Next, the developing device shown by FIG. 1 was set in a copier, IMAGIO MF200, manufactured by Ricoh Company, Ltd., and an image was produced to evaluate the image density, background fouling, half tone image reproducibility and image density controllability by the following evaluation method. The results are shown in Table 3.

Examples 2 to 19 and Comparative Examples 1 to 2

The method and the evaluation of Example 1 was repeated except for using the combinations of the toner and the carrier shown in Table 3. The results are shown in Table 3.

Evaluation (Image Density)

The image density of 9 solid-developed images of the upper part, the middle part and the under part of an original image was measured by a Macbeth densitometer Model No. RD514.

(Background Fouling)

Back ground fouling was classified to 5 grades. Not less than the 3rd grade was judged to be acceptable.

Grade 5: No background fouling

Grade 4: Scarcely any background fouling

Grade 3: Slight background fouling but acceptable

Grade 2: Unacceptable background fouling

Grade 1: Extremely bad background fouling (Half Tone Image Reproducibility)

The number of gradable images was counted after copying a gray scale No. Q-13 from Kodak.

The evaluation standard was determined as follows:

◎: not less than 13

○: 10 to 12

Δ: 7 to 9

×: 5 to 6

××: less than 5

(Image Density Controllability)

20 pieces of a 100% solid image having an original image density of 1.6 were copied continuously to evaluate the change of the image density.

The evaluation standard was determined by the difference of the image density between the original and the produced image as follows:

TABLE 3

| | Name of Toner | Name of Carrier | Evaluation results: Image density | Background fouling | Half tone reproducibility | Change of image density |
|---|---|---|---|---|---|---|
| Example 1 | a | A | 1.55 | 5 | ○ | ◎ |
| Example 2 | b | A | 1.49 | 4 | ○ | ◎ |
| Example 3 | c | A | 1.55 | 5 | ○ | ◎ |
| Example 4 | d | A | 1.51 | 4 | ○ | ◎ |
| Example 5 | e | A | 1.55 | 4 | ○ | ◎ |
| Example 6 | f | A | 1.47 | 2 | ○ | ◎ |
| Example 7 | g | A | 1.36 | 5 | ○ | ◎ |
| Example 8 | h | A | 1.57 | 4 | ○ | ◎ |
| Comparative example 1 | I | A | 1.16 | 5 | ○ | ◎ |
| Example 9 | j | A | 1.50 | 5 | ○ | ◎ |
| Example 10 | k | A | 1.38 | 5 | ○ | ◎ |
| Example 11 | l | A | 1.54 | 5 | ◎ | ○ |
| Example 12 | m | A | 1.51 | 4 | ◎ | Δ |
| Example 13 | n | A | 1.44 | 5 | ○ | ◎ |
| Example 14 | o | A | 1.46 | 5 | ○ | ◎ |
| Example 15 | p | A | 1.50 | 5 | ◎ | ○ |
| Example 16 | q | A | 1.49 | 5 | ○ | ◎ |
| Example 17 | r | A | 1.53 | 3 | ◎ | Δ |
| Example 18 | s | A | 1.26 | 5 | Δ | ◎ |
| Example 19 | t | A | 1.52 | 5 | ○ | ◎ |
| Comparative example 2 | u | A | 1.04 | 4 | ○ | ◎ |

◎: less than 0.1
○: not less than 0.1 and less than 0.2
Δ: not less than 0.2 and less than 0.5
X: not less than 0.5

Obviously, numerous modifications and variations of the present invention are possible in light of the above teachings. It is therefore to be understood that within the scope of the appended claims, the invention may be practiced otherwise than as specifically described herein.

What is claimed as new is:

1. A two-component developer comprising:

a magnetic toner including magnetic particles coated with a carbon black layer; and a magnetic carrier configured to carry the magnetic toner on a surface thereof.

2. The two-component developer of claim 1, wherein the magnetic toner comprises magnetic particles between 10 to 30% by weight.

3. The two-component developer of claim 1, wherein the magnetic particles of the magnetic toner are complex magnetic particles comprising a coated layer of a carbon black powder and a silane coupling agent as a binder resin.

4. The two-component developer of claim 1, wherein the magnetic particles of the magnetic toner comprises:

silane coupling agent between 0.3 to 3.0% by weight; and carbon black powder between 3 to 20% by weight per 100% by weight of the magnetic particles.

5. The two-component developer of claim 1, wherein the magnetic toner has a magnetization (at) between 10 to 30 emu/g at a magnetic field of 1000 Oe.

6. The two-component developer of claim 1, wherein the magnetic particles comprise a spherical shape and are free from silicon or an aluminium atom.

7. The two-component developer of claim 1, wherein the magnetic toner comprises magnetic particles having a magnetization (σt) between 30 to 90 emu/g at a magnetic field of 1000 Oe.

8. The two-component developer of claim 1, wherein the magnetic particles of the magnetic toner comprise an average particle diameter between 0.2 to 0.4 μm.

9. The two-component developer of claim 1, wherein the magnetic particles of the magnetic toner comprise a specific surface area bewtween 1 to 60 m/g.

10. The two-component developer of claim 1, wherein an average particle diameter of the magnetic toner is between 5 to 15 μm and an average particle diameter of the magnetic carrier between 20 to 100 μm.

11. The two-component developer of claim 1, wherein the weight ratio of the magnetic toner and the magnetic carrier between 10/90 to 50/50.

12. The two-component developer of claim 1, wherein the magnetic toner further comprises a polarity controller having an average particle diameter of not greater than 3 μm, and 0.2 to 10 parts by weight per 100 parts by weight of the binder resin.

13. The two-component developer of claim 1, wherein the magnetic toner further comprises a colorant having between 0.1 to 3 parts by weight per 100 parts by weight of the binder resin.

14. The two-component developer of claim 1, wherein the magnetic toner further comprises a release agent having between 0.1 to 10 parts by weight per 100 parts by weight of the binder resin.

15. The two-component developer of claim 1, wherein the magnetic carrier comprises a silicone resin coated layer having a thickness of from 0.1 to 20 μm.

16. The two-component developer of claim 15, wherein the magnetic carrier comprises an electroconductive additive in the coated layer having 5 to 20 parts by weight per 100 parts by weight of the coated resin.

17. The two-component developer of claim 15, wherein the silicon coated layer comprises a silane coupling agent in the coated layer.

18. A developer container, comprising:

a first compartment configured to store a magnetic toner including magnetic particles coated with a carbon black layer; and a second compartment configured to store a magnetic carrier configured to carry the magnetic toner on a surface thereof.

19. An image forming apparatus comprising:

a toner container including a magnetic toner with magnetic particles coated with a carbon black layer, and configured to supply the magnetic toner to a developer carrier;

a developer container including a magnetic carrier configured to carry the magnetic toner on a surface thereof and in which the magnetic toner is mixed with the magnetic carrier so to create a two-component developer;

a first regulating member configured to control a volume of the two-component developer transported by the developer carrier; and a second regulating member arranged to border a region with the developer carrier, and configured to regulate how much magnetic toner is transferred to the developer container, wherein the second regulating member changes a mixing ratio of the magnetic carrier and magnetic toner, according to a change of a magnetic toner concentration of the two-component developer on the developer carrier.

20. An image forming method comprising:

forming a latent image on a photoreceptor; and developing the latent image by a developer, wherein the developer is a two-component developer comprising:

a magnetic toner including magnetic particles coated with a carbon black layer; and a magnetic carrier configured to carry the magnetic toner on a surface thereof.

* * * * *